US005531147A

United States Patent [19]

Serban

[11] Patent Number: 5,531,147

[45] Date of Patent: Jul. 2, 1996

[54] SAW GUARD

[75] Inventor: George Serban, Ft. Lauderdale, Fla.

[73] Assignee: Alpine Engineered Products, Inc., Pompano Beach, Fla.

[21] Appl. No.: 323,833

[22] Filed: Oct. 17, 1994

Related U.S. Application Data

[63] Continuation-in-part of Ser. No. 155,726, Nov. 23, 1993, abandoned.

[51] Int. Cl.[6] ..... B27G 19/02

[52] U.S. Cl. ..... 83/478; 83/544; 30/391; 144/251.1

[58] Field of Search ..... 83/478, 546, 397, 83/544; 30/391; 144/251 R; 74/613

[56] References Cited

U.S. PATENT DOCUMENTS

| | | | |
|---|---|---|---|
| 4,163,404 | 8/1979 | Lavis | 83/165 |
| 4,549,456 | 10/1985 | Elmaraghy et al. | 83/478 |
| 4,581,966 | 4/1986 | Kaiser et al. | 83/397 |
| 4,614,140 | 9/1986 | Macksoud | 83/397 |
| 4,875,398 | 10/1989 | Taylor et al. | 83/100 |

*Primary Examiner*—Rinaldi I. Rada

*Assistant Examiner*—Clark F. Dexter

*Attorney, Agent, or Firm*—Oltman and Flynn

[57] ABSTRACT

A guard apparatus for covering the cutting edge of a circular blade of a radial power saw includes a pivoting guard member extending over a portion of the cutting edge of the blade, mounted to rotate essentially coaxially with the blade, and a fluid driven cylinder and piston mechanism connected to the pivoting guard member for automatically rotating the pivoting guard member to an open position to expose the cutting edge of the blade to a work piece to make a cut and to a closed position upon completion of the cut. The guard apparatus preferably includes an electric circuit and valves for controlling the flow of the fluid into the cylinder and piston mechanism to cause the cylinder and piston mechanism to rotate the pivoting guard member to a closed position upon completion of a cut, a switch mechanism for operating the electric circuit, and a cam portion protruding from the pivoting guard member for bearing against and activating the switch mechanism. The guard apparatus further includes a positionally fixed guard member covering the upper half of the blade, the pivoting guard member and the switch mechanism are preferably mounted within the fixed guard member. The pivoting guard member preferably includes an inner plate having a plate mounting port, a radial flange attached to the inner plate, and an outer plate attached to the radial flange.

5 Claims, 4 Drawing Sheets

SAW GUARD

This application is a continuation-in-part of application Ser. No. 08/155,726, filed on Nov. 23, 1993, now abandoned.

BACKGROUND OF THE INVENTION

1. Field of the Invention

The present invention relates generally to the field of guard members for shielding saw operators from blades. More specifically, it relates to a pivoting guard for use on a circular saw blade mounted on an extendable arm and motor assembly overhanging a saw table. The guard apparatus takes the form of a channel member rotatably mounted on the motor assembly and over the blade, preferably within a conventional, stationary guard member, which can be rotated to expose the blade as the blade approaches a work piece and rotated to cover the blade when a cut in the work piece is completed. The guard apparatus preferably includes an air driven piston and cylinder having a piston shaft connected to the pivoting guard, to automatically withdraw the piston shaft and thereby rotate the guard to an open position, and a radially protruding cam portion on the guard against which a lever rides to operate a switch to detect when the guard is fully open, and then to automatically extend the piston shaft to close the guard.

2. Description of the Prior Art

There have long been guard members for shielding people from moving saw blades. These guard members are often fixed in position, and to permit a work piece to meet the blade, can leave a substantial portion of the blade dangerously exposed. Others are expensive and complicated.

Taylor et al., U.S. Pat. No. 4,875,398, issued on Oct. 24, 1989, teaches a retractable dust control and safety hood for a rotary table saw. A hood is attached by counterbalanced linkages to a beam support structure so that the hood can be pivoted down against a work piece and then up and out of the way. A vacuum hose evacuates saw dust from within the hood and carries it out through the support structure. The hood has a window through which to view the saw operation. A problem with Taylor et al. is that the linkages, counterbalance mechanism, vacuum hose and assembly make the protective hood apparatus bulky and expensive. Another problem with Taylor et al. is that the moving saw blade remains dangerously exposed until the work piece advances under the hood and the hood is lowered against it.

Macksoud, U.S. Pat. No. 4,614,140, issued on Sep. 30, 1986, discloses a guard for a rocking arm saw having a circular disk blade which can be pivoted up through a slot in a saw table. The pivoting blade mounting structure has a handle extending over the back of the table, and the guard is pivotally mounted on an arm extending from the blade handle toward the blade. In this way, as the blade is rocked up through the slot, the guard rocks up with the blade. The guard is spaced above the table to clear a work piece being cut, and the forward end of the guard tilts down to cover the teeth of the blade as the guard and blade rock toward the operator. Macksoud has an alternative configuration for rip sawing wherein the blade continuously protrudes through the slot. The guard is pivotally attached to an end of a mounting arm, and the other end of the arm is pivotally attached to a vertical stand. The work piece is slid under an angled front edge of the guard and gradually tilts the guard upward as the work piece moves under it. A problem with Macksoud is that its structure limits its use to saws having the blade protruding up through a slot in a table. Another problem is that no provision is made for automating the guard, and manual operation can limit assembly line speed.

Kaiser et al., U.S. Pat. No. 4,581,966, issued on Apr. 15, 1986, reveals a chop saw linkage system with a swinging blade guard. The blade is a circular disk type and is rotatably mounted within a housing covering the upper half of the blade. The housing is itself pivotally mounted at an end so that the blade and housing can be lowered to make a saw cut and then tilted back up to a stable rest position. Kaiser et al. provides a guard member rotatably mounted on the blade axle and guard linkages contained within the housing. The linkages cause the guard member to swing over and cover the exposed part of the blade when the housing is raised, and to swing to expose the blade when the housing and blade are lowered to make a cut. A problem with Kaiser et al. is that the linkage structure limits the automatic guard to use on chop saws.

Elmaraghy et al., U.S. Pat. No. 4,549,456, issued on Oct. 29, 1985, teaches a noise damping guard for circular table saws. Elmaraghy et al. includes an upper guard mounted on a pivoting arm structure above the table and a lower guard secured around the blade slot under the table. The noise damping is effected by a sandwich material closely spaced to the saw blade side walls for destroying some of the blade vibratory energy. The sandwich material has high transmission loss and barrier characteristics and can withstand blade contact. A problem with Elmaraghy et al. is that the upper guard and lower guard must be separated to insert a work piece, thereby exposing a substantial segment of the blade cutting edge. Another problem is that the noise dampening layers of material and the support structure make Elmaraghy et al. costly.

Lavis, U.S. Pat. No. 4,163,404, issued on Aug. 7, 1979, discloses a circular power saw assembly which can be mounted to rotate horizontally on a table. Lavis is not directed to a saw guard, but includes a guard which is described as conventional. The guard rotates on the blade axle and is spring-loaded. A problem with Lavis is that the guard only covers a certain portion of the blade cutting edge, and rotating the guard leaves the same portion of the cutting edge dangerously exposed.

It is thus an object of the present invention to provide a saw guard which is adapted for use on a radial arm saw.

It is another object of the present invention to provide such a saw guard which can operate in conjunction with an existing, stationary guard to completely cover the blade cutting edge between saw cuts.

It is still another object of the present invention to provide such a saw guard which automatically opens to expose the blade for a saw cut and automatically closes upon completion of the cut.

It is finally an object of the present invention to provide such a saw guard which is simple, reliable, and inexpensive to manufacture.

SUMMARY OF THE INVENTION

The present invention accomplishes the above-stated objectives, as well as others, as may be determined by a fair reading and interpretation of the entire specification.

A guard apparatus is provided for covering the cutting edge of a circular blade of a radial power saw, including a pivoting guard member extending over a portion of the cutting edge of the blade, mounted to rotate essentially coaxially with the blade, and a fluid driven cylinder and piston mechanism connected to the pivoting guard member for automatically rotating the pivoting guard member to an open position to expose the cutting edge of the blade to a work piece to make a cut and to a closed position upon completion of the cut. The guard apparatus preferably includes an electric circuit and valves for controlling the flow of the fluid into the cylinder and piston mechanism to cause the cylinder and piston mechanism to rotate the pivoting guard member to a closed position upon completion of a cut, a switch mechanism for operating the electric circuit, and a cam portion protruding from the pivoting guard member for bearing against and activating the switch mechanism. Where the radial saw includes a positionally fixed guard member covering the upper half of the blade, the pivoting guard member and the switch mechanism are preferably mounted within the fixed guard member. The pivoting guard member preferably includes an inner plate having a plate mounting port, a radial flange attached to the inner plate, and an outer plate attached to the radial flange. The inner plate is preferably essentially a half disk having a circumferential edge to which the radial flange is attached. Similarly, the outer plate is preferably essentially a half disk having a circumferential edge to which the radial flange is attached.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
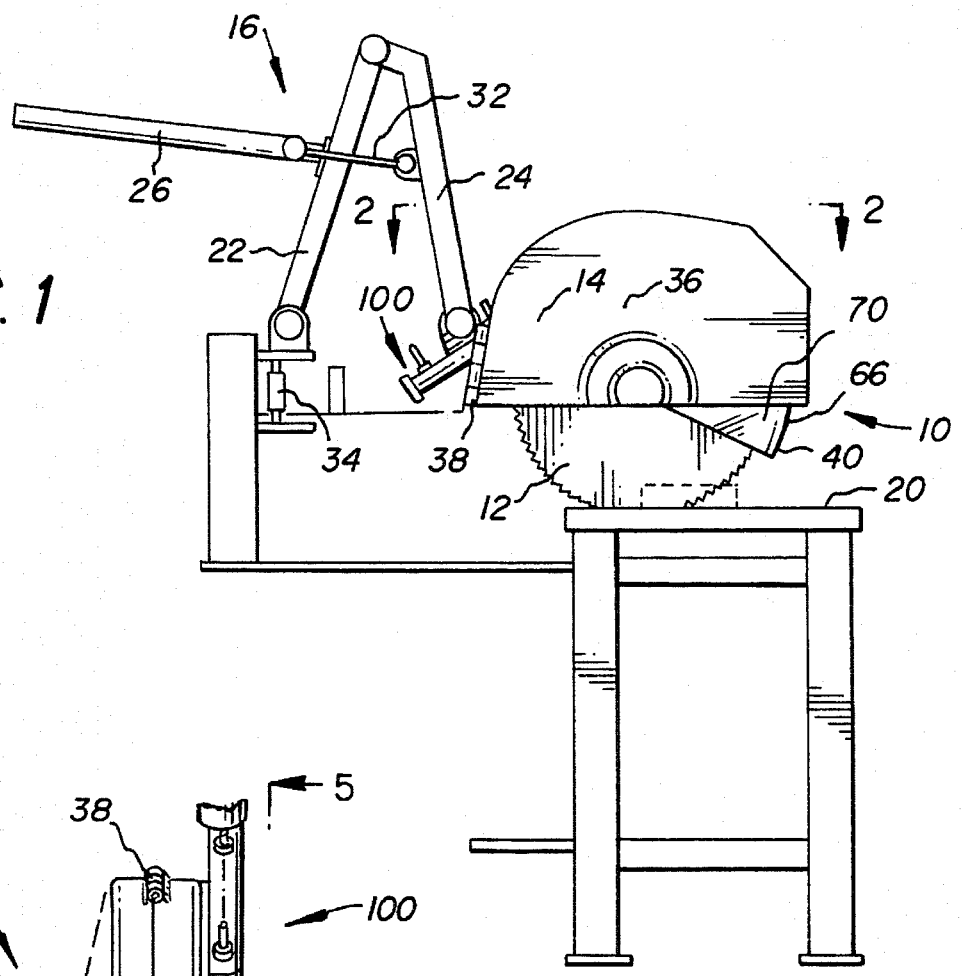
FIG. 1 is a side view of a radial arm saw equipped with the inventive pivoting guard apparatus showing the air driven piston and cylinder assembly for automatically rotating the guard channel member.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
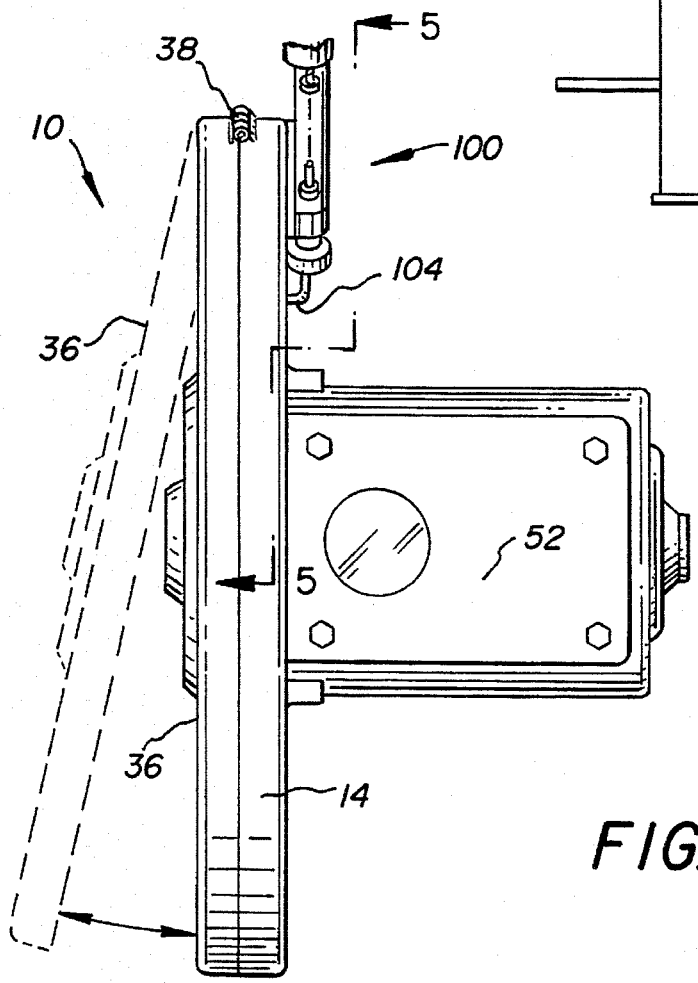
FIG. 2 is a top view of the saw motor and fixed guard member showing in broken lines the outer plate of the fixed guard member pivoted on its hinge to an open position, and also showing the air driven piston and cylinder assembly of the pivoting guard.

Referring to FIG. 1, a saw guard apparatus 10 is disclosed for covering the exposed edge of a circular saw blade 12 on a radial arm saw. Blade 12 is mounted within a conventional fixed guard member 14, on an extendable arm and motor assembly 16 overhanging a saw table 20. Arm assembly 16 includes pivoting arm linkages 22 and 24 and an air cylinder 26 and piston with a piston shaft 32 attached to linkage 24 to extend assembly 16 over saw table 20. The illustrated arm assembly 16 pivots horizontally over table 20 on an arm hinge 34. The outer plate 36 of fixed guard member 14 opens on a hinge 38 to permit removal and replacement of blade 12. See FIG. 2.

Guard apparatus 10 includes a channel member 40 rotatably mounted within fixed guard member 14 on the cylindrical guard mount 46, projecting coaxially with the blade axle 50. Axle 50 is the drive shaft of electric motor 52. See FIG. 3. Channel member 40 can be rotated on guard mount 46 to expose blade 12 as blade 12 approaches a work piece, and rotated to cover blade 12 when a saw cut is completed.

Channel member 40 includes an essentially semi-circular inner plate 54 having a central mounting port 56, and is attached with screws 62 to a radial flange 64 extending along its circumferential edge 66. See the exploded view of FIG. 4 and the assembled view of FIG. 3. The radius of inner plate 54 is slightly larger than that of blade 12, so that blade 12 can fit within flange 64. An outer plate 70 having essentially the same dimensions as inner plate 54 and a semi-circular, service access port 68 attaches to flange 64 with screws 62.

Figure 3:
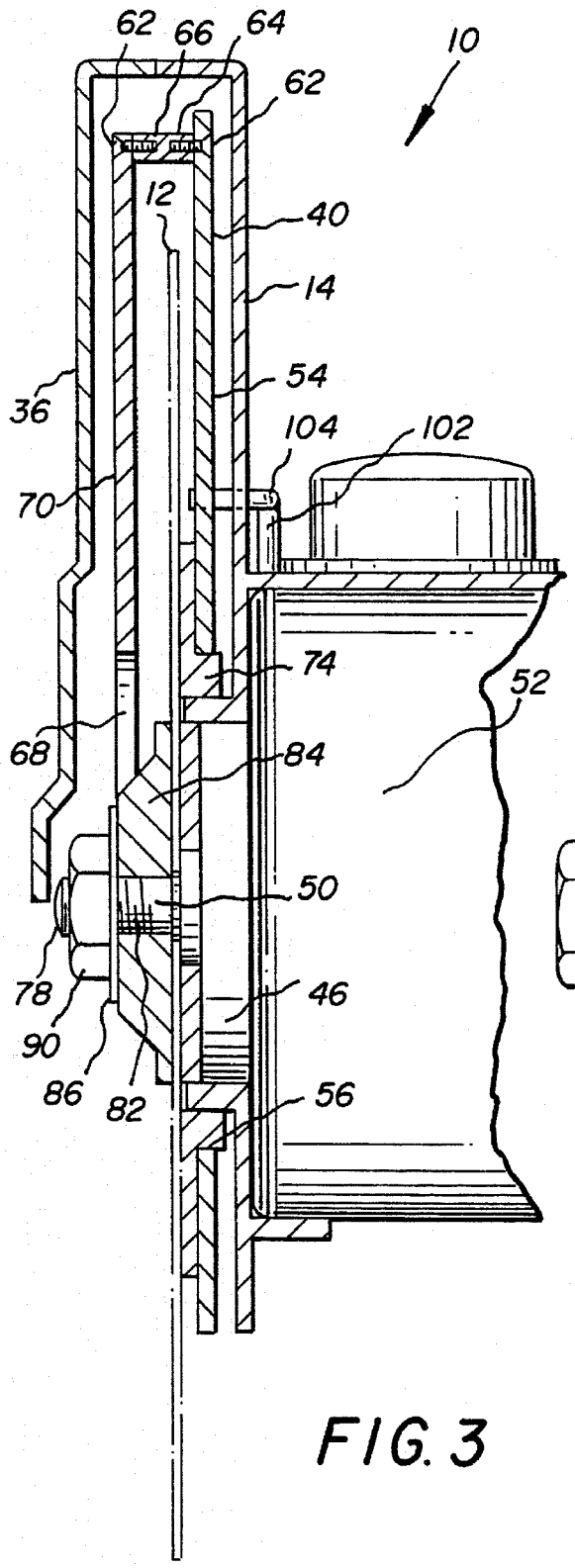
FIG. 3 is a top view of the saw blade and saw motor, with the pivoting guard and fixed guard member in cross-section, showing the blade and guard mounting elements in an assembled configuration.
Figure 4:
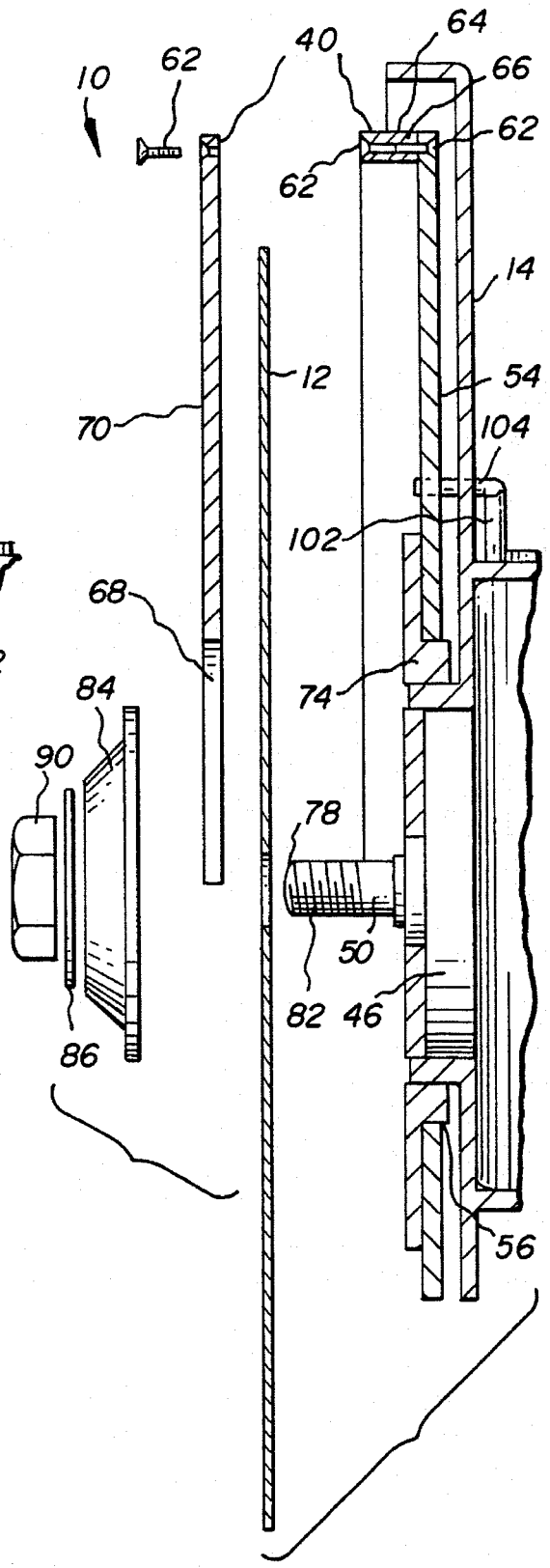
FIG. 4 is a view as in FIG. 3, except that the mounting elements, pivoting guard elements and blade are shown in a partially exploded configuration.
Figure 5:
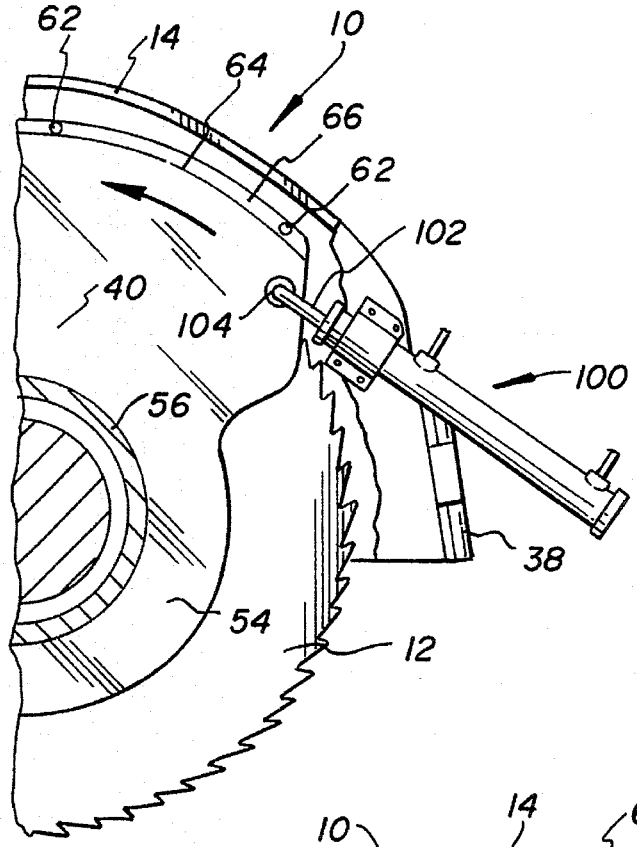
FIG. 5 is a broken, rear view of the saw blade, with the fixed guard member in cross-section, revealing the pivoting guard and the pivoting guard piston and cylinder assembly, with an arrow indicating the direction the pivoting guard will rotate when the piston shaft is extended.
Figure 6:
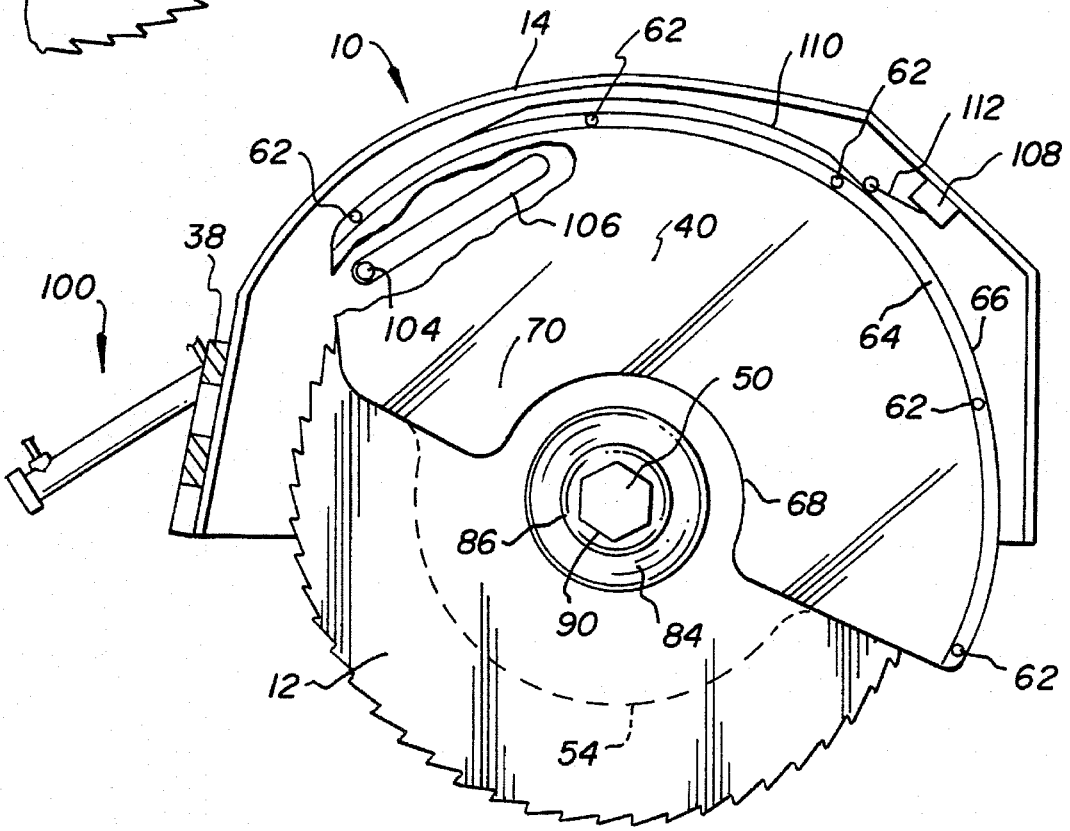
FIG. 6 is a front view of the saw blade and pivoting guard air cylinder, with the fixed guard member in cross-section to reveal the pivoting guard in a raised, open position, and a portion of the pivoting guard and blade cut away to reveal the slot in which the pivoting guard engaging member rides.

FIGS. 3 and 4 also show how the elements of channel member 40 are assembled onto arm and motor assembly 16. A flanged ring member 74 is pressed into central mounting port 56, and ring member 74 is in turn rotatably fit around guard mount 46. Radial flange 64 is fastened to inner plate 54 with screws 62, and then saw blade 12 fits over blade axle 50 and within radial flange 64. Outer plate 70 is attached to radial flange 64 with screws 62. The exposed end 78 of axle 50 has threads 82, and a mounting dish 84 and washer 86 slide over end 78, and are anchored against blade 12 with a nut 90 screwed onto threads 82.

Figure 7:
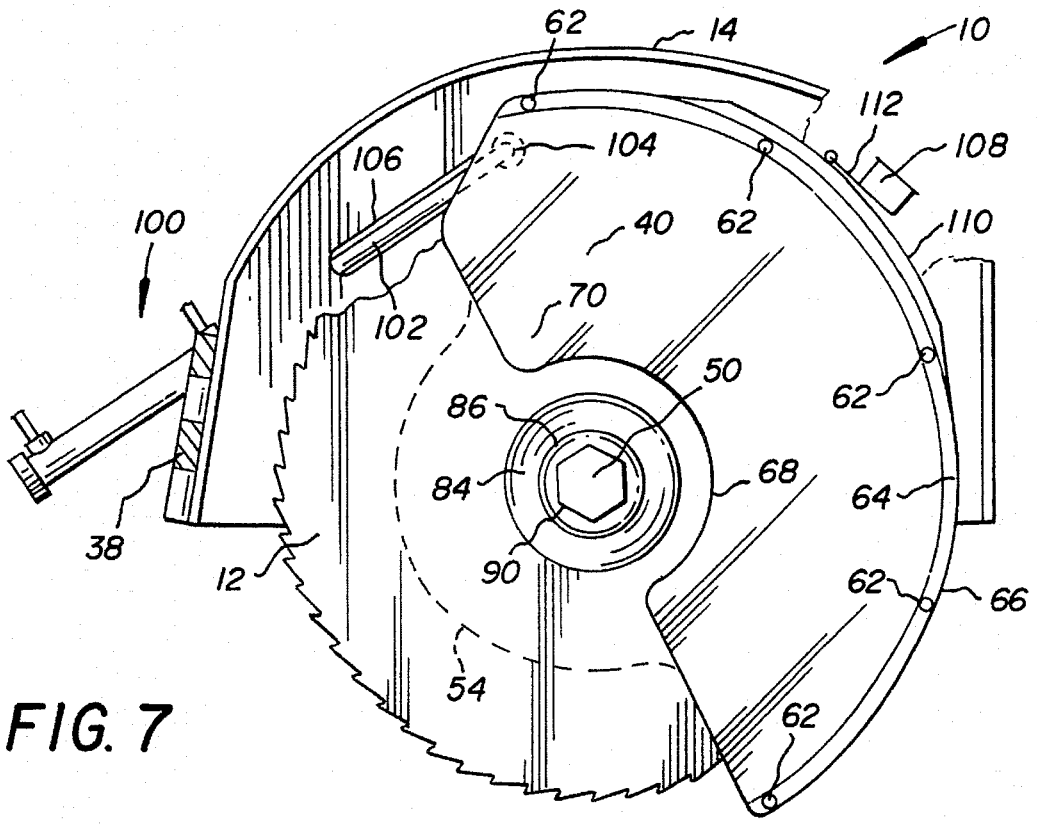
FIG. 7 is a view as in FIG. 6, except that the pivoting guard is advanced to the closed position, indicating the new position of the pivoting guard piston shaft within the guard engaging member slot.
Figure 8:
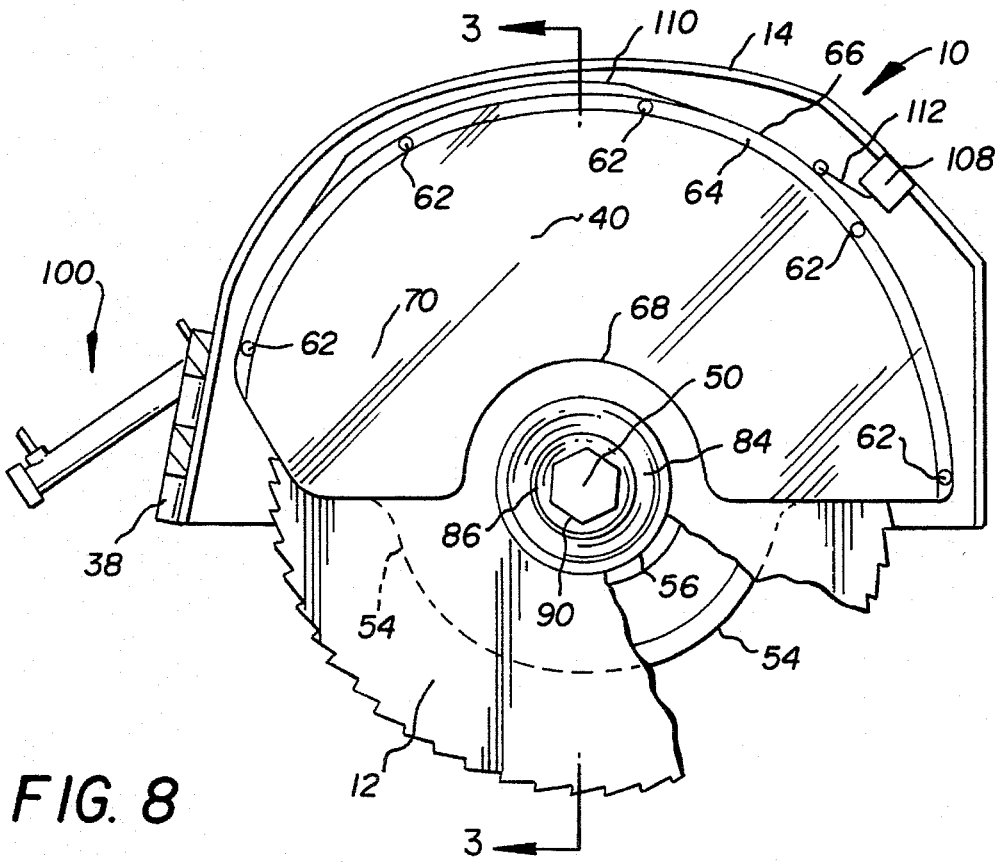
FIG. 8 is a side view of the saw blade and inventive pivoting guard apparatus, showing the fixed, outer guard in cross-section and revealing the lever switch and radially protruding cam portion of the channel member.

Apparatus 10 includes a guard controlling, air piston and cylinder assembly 100. Assembly 100 includes a piston shaft 102 having a perpendicular engaging member 104 connected to the periphery of channel member 40 through a slot 106 in fixed guard member 14. See FIGS. 4, 5, 6 and 7. At the push of a button, assembly 100 automatically withdraws piston shaft 102 to rotate channel member 40 to an open position. See FIG. 8. A switch 108 operated by a switch actuator member in the form of a spring-loaded lever 112 is mounted within fixed guard member 14. Lever 112 rides against a cam portion 110, which protrudes radially from the outer surface of channel member 40, as channel member 40 is rotated to an open position by the withdrawal of shaft 102. See FIG. 7. When channel member 40 reaches a fully open position, switch lever 112 rides off of cam portion 110, thereby operating switch 108. See FIG. 8. This causes switch 108 to activate an air source such as a pump to deliver air into assembly 100 to extend piston shaft 102. The extension of piston shaft 102 automatically moves channel member 40 to once again cover blade 12. Then another workpiece may be placed in position on the saw machine to be cut, and the button again pushed to once again open channel member 40.

Apparatus 10 may also be operated manually, without assembly 100. In this instance, a handle protrudes from perpendicular engaging member 104 through slot 106.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A guard apparatus for covering the cutting edge of a circular blade of a radial power saw, comprising:

a pivoting guard member extending over at least a portion of said cutting edge of said blade, and mounting means for mounting said pivoting guard member to rotate essentially coaxially with said blade, guard rotation means for rotating said pivoting guard member to an open position to expose said cutting edge of said blade to a work piece to make a cut and to a closed position to cover the exposed cutting edge, and, activating means for activating said guard rotation means to cause said guard rotation means to rotate said pivoting guard member to a closed position, wherein said activating means includes, a cam portion protruding from said pivoting guard member, said cam portion having a cam surface, and switch means cooperating with said can surface for activating said guard rotation means, said switch means comprising a switch actuator member biased to ride against said cam surface, such that movement of said switch actuator member resulting from riding over said cam surface operates said switch means.

2. A guard apparatus according to claim 1, further comprising a positionally fixed guard member covering the upper half of said blade, wherein said pivoting guard member and said switch means are mounted within said fixed guard member.

3. A guard apparatus according to claim 1, wherein said pivoting guard member comprises:

an inner plate having a plate mounting port, a radial flange attached to said inner plate, and an outer plate attached to said radial flange.

4. A guard apparatus according to claim 3, wherein said inner plate is essentially a half disk having a circumferential edge to which said radial flange is attached.

5. A guard apparatus according to claim 3, wherein said outer plate is essentially a half disk having a circumferential edge to which said radial flange is attached.

* * * * *